United States Patent [19]

Zijsling

[11] Patent Number: 4,792,001

[45] Date of Patent: Dec. 20, 1988

[54] ROTARY DRILL BIT

[75] Inventor: Djurre H. Zijsling, Rijswijk, Netherlands

[73] Assignee: Shell Oil Company, Houston, Tex.

[21] Appl. No.: 12,920

[22] Filed: Feb. 9, 1987

[30] Foreign Application Priority Data

Mar. 27, 1986 [GB] United Kingdom ..... 8607701

[51] Int. Cl.[4] ..... E21B 10/46

[52] U.S. Cl. ..... 175/329; 175/410

[58] Field of Search ..... 175/329, 410

[56] References Cited

U.S. PATENT DOCUMENTS

| | | | |
|---|---|---|---|
| 3,745,623 | 7/1973 | Wentorf et al. | 29/95 B |
| 3,885,637 | 5/1975 | Veprintsev et al. | 175/329 |
| 3,938,599 | 2/1976 | Horn | 175/329 |
| 4,098,362 | 7/1978 | Bonnice | 175/329 |
| 4,098,363 | 7/1978 | Rohde et al. | 175/329 |
| 4,194,790 | 3/1980 | Kenny et al. | 175/410 X |
| 4,244,432 | 1/1981 | Rowley et al. | 175/329 |
| 4,396,077 | 8/1983 | Radtke | 175/329 |
| 4,465,147 | 8/1984 | Feenstra et al. | 175/73 |
| 4,485,879 | 12/1984 | Kamp et al. | 175/61 |
| 4,492,276 | 1/1985 | Kamp | 175/61 |
| 4,529,048 | 7/1985 | Hall | 175/407 |
| 4,602,691 | 7/1986 | Weaver | 175/329 |
| 4,607,711 | 8/1986 | Zijsling | 175/410 X |

FOREIGN PATENT DOCUMENTS

| | | |
|---|---|---|
| 0029187 | 5/1981 | European Pat. Off. . |
| 0109699 | 10/1983 | European Pat. Off. . |
| 85200184 | 9/1985 | European Pat. Off. . |
| 828214 | 11/1982 | South Africa . |
| 2084219 | 4/1982 | United Kingdom . |

OTHER PUBLICATIONS

"The Thermal Response of Polycrystalline Diamond Compact Cutters Under Simulated Downhole Conditions," D. A. Glowka and C. M. Stone, Society of Petroleum Engineers of AIME, SPE 11947, Oct. 1983.

"Analysis of Temperature Distribution of Performance of Polycrystalline Diamond Compact Bits Under Field Drilling Conditions," D. J. Zijsling, Society of Petroleum Engineers of AIME, SPE 13260, Sep. 1984.

*Primary Examiner*—Stephen J. Novosad
*Assistant Examiner*—William P. Neuder

[57] ABSTRACT

A rotary drill bit is provided with a plurality of cutting elements having a front layer of abrasive particles, wherein the cutting elements located in the center region of the bit comprise a thicker abrasive front layer than those in the outer region of the bit. The bit design enables optimization of drilling characteristics.

17 Claims, 1 Drawing Sheet

ROTARY DRILL BIT

BACKGROUND OF THE INVENTION

The invention relates to a rotary drill bit for deephole drilling in subsurface earth formations, and in particular to a drill bit including a bit body which is suitable to be coupled to the lower end of a drill string and carries a plurality of cutting elements.

Bits of this type are known and disclosed, for example, in U.S. Pat. Nos. 4,098,362 and 4,244,432. The cutting elements of the bits disclosed in these patents are preformed cutters in the form of cylinders that are secured to the bit body either by mounting the elements in recesses in the body or by brazing or soldering each element to a pin which is fitted into a recess in the bit body. The impacts exerted to the cutting elements during drilling are severe and in order to avoid undue stresses in the elements, the frontal surface of each element is generally oriented at a negative top rake angle between zero and 20 degrees.

The cutting elements usually comprise an abrasive front layer consisting of synthetic diamonds or cubic boron nitride particles that are bonded together to a compact polycrystalline mass. The front layer of each cutting element may be backed by a cemented tungsten carbide substratum to take the thrust imposed on the front layer during drilling. Preformed cutting elements of this type are disclosed in U. S. Pat. No. 4,194,790 and in European patent specification No. 0029187 and they are often indicated as composite compact cutters, or—in case the abrasive particles are diamonds—as polycrystalline diamond compacts (PDC's).

The cutting elements of bits of the above type are usually provided with an abrasive front layer of which the thickness is selected such that a compromise is accomplished between various desired drilling characteristics.

For example, a low thickness of the abrasive front layer provides a cutting element that remains comparatively sharp throughout its life, so that a high bit agressiveness level (defined as the ratio between bit torque and weight on bit) is achieved. However, a high bit agressiveness level has the consequence that in certain formations the stalling tendency of the bit as a result of weight on bit fluctuations is high. In particular, if the bit is driven by a downhole drive such as a mud driven turbine, this stalling tendency may result in continuous fluctuations of the bit rotation rate and a poor drilling progress.

SUMMARY OF THE INVENTION

An object of the present invention is to provide a drill bit of which the bit agressiveness level can be designed so that a high drilling penetration rate can be achieved without increasing the stalling tendency of the bit.

Further objects of the invention are to provide a drill bit having a high course stability and a constant drilling performance throughout its life.

In accordance with the invention these objects are accomplished by a drill bit comprising a bit body and a plurality of cutting elements protruding from the bit body, said elements comprising a front layer of abrasive particles, wherein the cutting elements located in the center region of the bit comprise a thicker abrasive front layer than those in the outer region of the bit.

BRIEF DESCRIPTION OF THE DRAWINGS

The invention will now be explained in more detail and by way of example with reference to the accompanying drawing, in which.

DETAILED DESCRIPTION OF THE PREFERRED EMBODIMENTS

Figure 1:
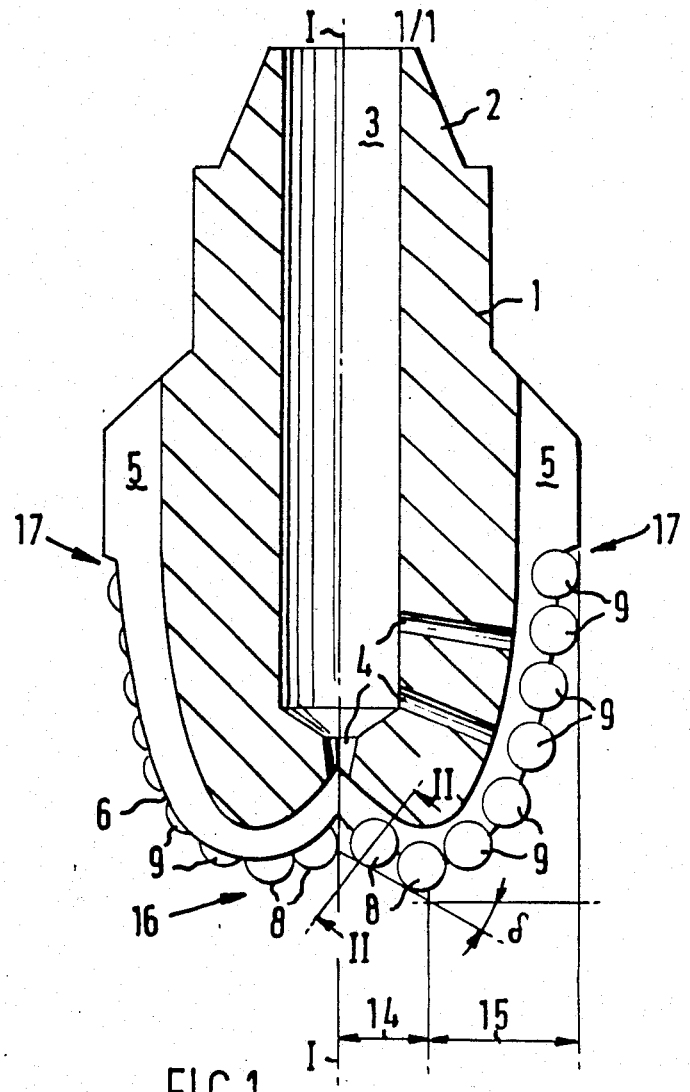
FIG. 1 shows a vertical section of a rotary drill bit constructed in accordance with the present invention.

The rotary drill bit shown in FIG. 1 comprises a crown-type bit body 1 which is provided at its upper end with a screw thread coupling 2 for coupling the bit to the lower end of a drill string.

The bit body 1 comprises a central bore 3 for allowing drilling mud to flow from the interior of the drill string via a series of nozzles 4 into radial flow channels 5 that are formed in the bit face 6 in front of the cutting elements 8, 9 to allow the mud to cool the elements and to flush drill cuttings therefrom upwards into the surrounding annulus.

The cutting elements are arranged in radial arrays such that the frontal surfaces 10 (see FIG. 2) are flush to one of the side walls of the flow chanels 5. The radial arrays of cutting elements 8, 9 are angularly spaced about the bit face 6 and in each array the cutting elements 8, 9 are arranged in a staggered overlapping arrangement with respect to the elements 8, 9 in adjacent arrays so that the concentric grooves that are carved during drilling by the various cutting elements 8, 9 into the borehole bottom cause a uniform deepening of the hole.

The cutting elements 8, 9 (see FIG. 2) are Polycrystalline Diamonds Compact (PDC) elements comprising a polycrystalline diamond front layer 11 and a tungsten carbide substratum 12.

The front layer may comprise other abrasive particles, instead of diamond particles, such as boron nitride particles, as well.

In accordance with the invention, the thickness T of front layers 10 of the cutting elements located in the center region 14 of the bit face 6 is larger than the thickness of the front layers of the cutting elements 9 located in the outer region 1 of the bit face 6. In the crown bit configuration shown in FIG. 1 the center region 14 lies between the central axis I of the bit and the lowermost region 16 of the bit face 6, whereas the outer region 15 of the bit face runs from said lowermost region 16 to the outer circumference 17 of the bit face 6.

Figure 2:
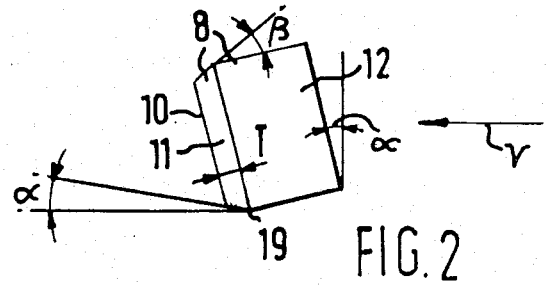
FIG. 2 shows one of the cutting elements in the center region of the bit of FIG. 1, taken in cross section along line II—II.

Furthermore, as illustrated in FIG. 2, at least all the cutting elements 8 in the center region have a chamfered diamond layer 11. The chamfer angle $\beta$ and the top rake angle $\gamma$ should be such that a negative rake angle $\alpha$ occurs at the cutting edge 19 of the fresh cutting element 8 relative to the borehole bottom. The value of $\alpha$ should be about equal to the wear flat angle developed as a result of the wear process of these cutting elements. As disclosed in Applicant's European patent application No. 85200184.1 (publication No. 0155026; publication date: Sept. 18, 1985) the wear flat angle remains substantially equal throughout the bit life. In general this angle is in the order of 10 to 15 degrees, irrespective of the thickness T of the front layer 11, weight-on-bit (WOB) and the velocity v of the element 8 relative to the hole bottom. The chamfered shape of the diamond layer implies that the cutting element 8 in fresh condition behaves like a worn cutter. This also means that the agressiveness of the bit (defined as the ratio between torque on bit and weight on bit) is constant throughout the bit life. The agressiveness level of the bit can now be controlled by selection of the proper diamond layer thickness for the cutting elements 8 and 9 in the inner and outer region. A thicker diamond layer requires a higher weight-on-bit (WOB) to penetrate the cutter into the rock. The drag load will increase as well. However, since the cutting elements 8 with the thick diamond layer are located in the center region, the extra drag load required will have a minimal effect on the torque requirement of the bit. So the bit agressiveness can be reduced by increasing the diamond layer thickness of cutting elements 8 in the center region relative to those in the outer region. This constant reduced agressiveness level of a bit throughout the bit life is of particular importance for drilling with the use of downhole drives, such as hydraulic motors driven by drilling mud. The stalling tendency of bit/downhole drive combination as a result of downhole WOB fluctuations is reduced.

In general, it is preferred to select the ratio between the thickness T of the diamond layer 11 on the cutting elements 8 in the center bit region 14 and the thickness of the diamond layer on the cutting elements 9 in the outer bit region 15 in the range from 1.1 to 10.

It is further preferred to select the thickness T of the diamond layers 11 of the elements 8 in the center bit region 14 between 0.55 and 3 mm and to select the thickness of the diamond layers of the elements 9 in the outer bit region 15 between 0.3 and 0.5 mm.

When the cutting elements 8 with a thick diamond layer 11 in the center region 14 generate a conical hole bottom with cone angle $\alpha$ (delta), the course stability of the bit is improved since during drilling the lateral components of the relatively large normal forces acting on these elements are in balance and urge the bit to deepen the hole in the direction of the bit axis I.

It will be understood that in deviated boreholes the lateral loads resulting from the weight of the bottom hole assembly relative to the lateral cutting loads are reduced so that course deviations of the bit during drilling in deviated boreholes are reduced as well. Since the lateral cutting loads are proportional to the WOB, the course stability will improve with WOB which is beneficial for the continuous steering concept using downhole drives disclosed, for example in European patent application No. 83201502.8.

The advantages of the bit concept illustrated in the drawing are that the drilling characteristics of the bit are constant throughout the bit life which helps to identify drilling problems; that a bit agressiveness level can be designed for which enables optimization of drilling with downhole drives; and that the course stability of the bit is improved.

It is observed that instead of the cylindrical shape of the cutting elements shown in the drawing, the cutting elements of the bit according to the invention may have any other suitable shape provided that the cutting elements in the center region of the bit are provided with an abrasive front layer having a larger thickness than those in the outer region of the bit. It will further be appreciated that the cutting elements may consist of a front layer only, which front layer is sintered directly to the hard metal bit body. Furthermore, it will be understood that instead of the particular distribution of the cutting elements along the bit face shown in FIG. 1, the cutting elements may be distributed in other patterns along the bit face as well.

Other modifications, changes and substitutions are intended in the foregoing disclosure and in some instances some features of the invention will be employed without a corresponding use of other features. Accordingly, it is appropriate that the appended claims be construed broadly and in a manner consistent with the spirit and scope of the present invention.

What is claimed is:

1. A rotary drill bit for deephole drilling in subsurface earth formations, the bit suitable to be coupled to the lower end of a drill string, said bit body having a center region near a central axis of rotation and an outer region further removed from the central axis; and a plurality of cutting elements protruding from the bit body, said cutting elements comprising a front layer of interbonded abrasive particles, wherein the cutting elements located in the center region of the bit comprise a thicker abrasive front layer than those in the outer region of the bit.

2. A rotary drill bit in accordance with claim 1 wherein the bit body has a crown-shaped bit face and said center region of the bit lies between the center of revolution of the bit and the lowermost region of the bit face, and the outer region of the bit runs from the lowermost region of the bit face to the outer circumference thereof.

3. A rotary drill bit in accordance with claim 2 wherein the cutting elements are distributed in substantially radial arrays along the bit face.

4. A rotary drill bit in accordance with claim 1 wherein the ratio between the thickness of the front layers of the cutting elements in the center region and the thickness of the front layers of the elements in the outer region is more than 1.1.

5. A rotary drill bit in accordance with claim 1 wherein the thickness of the front layers of the cutting element sin the center bit region is more than 0.55 mm and the thickness of the front layers of the elements in the outer bit region is less than 0.5 mm.

6. A rotary drill bit in accordance with claim 1 wherein at least the cutting elements in the center region are provided with an abrasive front layer having a chamfered shape.

7. A rotary drill bit in accordance with claim 6 wherein said abrasive front layer has an outer rim and a cutting edge, and wherein said chamfered shape is such that at the cutting edge of a fresh cutting element provided by the outer rim of the abrasive front layer is oriented at an acute angle relative to a plane defined by the direction of the motion of the cutting element and the intersection of the cutting element and the subsurface earth formation.

8. A rotary drill bit in accordance with claim 7 wherein said acute angle is between 10 degrees and 15 degrees.

9. A rotary drill bit for use with a drill string in deephole drilling in subsurface earth formations, the rotary drill bit comprising:

a plurality of cutting elements having a front layer of abrasive particles; and a bit body suitable for coupling to the lower end of the drilling string and supporting the cutting elements which protrude therefrom at select positions from a central axis of rotation and to a periphery of the bit body, the bit body comprising:

an outer region removed from the central axis of rotation and extending toward the periphery of the bit body; and a center region near the central axis and inside the outer region for which the front layer of abrasive particles is thicker than in the outer region.

10. A rotary drill bit in accordance with claim 9 wherein the bit body has a crown-shaped bit face and said center region of the rotary drill bit lies between the center of revolution of the rotary bit and the lowermost region of the bit face, and the outer region of the rotary drill bit runs from the lowermost region of the bit face to the outer circumference thereof.

11. A rotary drill bit in accordance with claim 10 wherein the cutting elements are distributed in substantially radial arrays along the bit face.

12. A rotary drill bit in accordance with claim 9 wherein the ratio between the thickness of the front layers of abrasive particles for the cutting elements in the center region and the thickness of the front layers of abrasive particles for the cutting elements in the outer region is more than 1.1.

13. A rotary drill bit in accordance with claim 9 wherein the thickness of the front layers of abrasive particles for the cutting elements in the center bit region is more than 0.55 mm and the thickness of the front layers of the elements in the outer bit region is less than 0.5 mm.

14. A rotary drill bit in accordance with claim 9 wherein at least the cutting elements in the center region are provided with a front layer of abrasive particles having a chamfered shape.

15. A rotary drill bit in accordance with claim 14 wherein the front layer of abrasive particles has an outer rim and said chamfered shape is such that a cutting edge of a fresh cutting element provided by the outer rim of the front layer of abrasive particles is oriented at an acute angle relative to a plane defined by the direction of the motion of the cutting element and the intersection of the cutting element and the subsurface earth formation.

16. A rotary drill bit in accordance with claim 15 wherein said acute angle is between 10 degrees and 15 degrees.

17. A rotary drill bit for use with a drill string in deep drilling through subsurface earth formations, the rotary drill bit comprising:

a plurality of cutting elements having a front layer of interbonded abrasive particles; and a bit body, comprising:

means for coupling the bit body to the lower end of the drill string; and a crown-shaped bit face supporting the cutting elements which protrude therefrom in substantially radial arrays, the bit face comprising:

a center region lying between the center of revolution of the bit and the lowermost region of the bit face wherein the front layer of abrasive particles for the cutting elements have a chamfered shaped which present a cutting edge of the outer rim of the front layer of abrasive particles at an angle of 10—15 degrees relative to the borehole bottom; and an outer region lying between the lowermost region of the bit face and the outer circumference thereof;

wherein the ratio between the thickness of the front layers of abrasive particles of the cutting elements in the center and outer regions is greater than 1.1.

* * * * *